US009075353B2

(12) United States Patent
Yoshimura et al.

(10) Patent No.: US 9,075,353 B2
(45) Date of Patent: Jul. 7, 2015

(54) IMAGE FORMING APPARATUS HAVING ENDLESS BELT CONTACT MEMBER

(71) Applicant: CANON KABUSHIKI KAISHA, Tokyo (JP)

(72) Inventors: Akira Yoshimura, Suntou-gun (JP); Masafumi Maeda, Yokohama (JP); Takeo Kawanami, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 119 days.

(21) Appl. No.: 13/851,269

(22) Filed: Mar. 27, 2013

(65) Prior Publication Data

US 2013/0266348 A1 Oct. 10, 2013

(30) Foreign Application Priority Data

Apr. 4, 2012 (JP) ..... 2012-085307

(51) Int. Cl.
*G03G 15/01* (2006.01)
*G03G 15/16* (2006.01)

(52) U.S. Cl.
CPC ..... *G03G 15/1615* (2013.01); *G03G 15/0131* (2013.01)

(58) Field of Classification Search
CPC ..... G03G 15/0131; G03G 15/1605; G03G 15/1675; G03G 15/161; G03G 2215/1614
USPC ..... 399/66, 298, 299, 302, 313, 314
See application file for complete search history.

(56) References Cited

U.S. PATENT DOCUMENTS

| | | | | |
|---|---|---|---|---|
| 5,495,317 | A * | 2/1996 | Matsuda et al. | 399/66 |
| 6,134,415 | A * | 10/2000 | Iwakura et al. | 399/299 |
| 6,173,149 | B1 * | 1/2001 | Kim | 399/313 |
| 6,421,521 | B2 * | 7/2002 | Tanaka | 399/299 |
| 7,289,757 | B2 * | 10/2007 | Sharma et al. | 399/299 |
| 7,415,232 | B2 | 8/2008 | Matsui et al. | |
| 7,917,071 | B2 | 3/2011 | Hirai et al. | |
| 8,112,014 | B2 | 2/2012 | Kawanami | |
| 8,355,650 | B2 | 1/2013 | Kawanami | |
| 2005/0078988 | A1 | 4/2005 | Matsui et al. | |

(Continued)

FOREIGN PATENT DOCUMENTS

| | | | |
|---|---|---|---|
| JP | 2004-94060 | A | 3/2004 |
| JP | 2005-77669 | A | 3/2005 |
| JP | 2005-352050 | A | 12/2005 |

(Continued)

*Primary Examiner* — William J Royer
(74) *Attorney, Agent, or Firm* — Fitzpatrick, Cella, Harper & Scinto

(57) ABSTRACT

An image forming apparatus includes a transfer rotary member for forming a primary transfer portion between a photosensitive drum and an intermediate transfer belt. The transfer rotary member includes multiple rotary members whose diameters are different, into which the transfer rotary member is divided in a direction orthogonal to a moving direction of the intermediate transfer belt. The transfer rotary member is arranged so as to contact a surface of the intermediate transfer belt on a side opposite to a surface with which multiple photosensitive drums come into contact at the primary transfer portions, on a downstream side in the moving direction of the intermediate transfer belt with respect to a contact portion between the intermediate transfer belt and each photosensitive drum, the intermediate transfer belt being arranged so as to protrude on the photosensitive drum side.

21 Claims, 10 Drawing Sheets

(56) References Cited

U.S. PATENT DOCUMENTS

| | | | |
|---|---|---|---|
| 2009/0097888 | A1 | 4/2009 | Hirai et al. |
| 2013/0164049 | A1 | 6/2013 | Kawanami et al. |

FOREIGN PATENT DOCUMENTS

| | | | |
|---|---|---|---|
| JP | 2009-98363 | A | 5/2009 |
| JP | 2011-232785 | A | 11/2011 |

* cited by examiner

IMAGE FORMING APPARATUS HAVING ENDLESS BELT CONTACT MEMBER

BACKGROUND OF THE INVENTION

1. Field of the Invention

The present invention relates to an image forming apparatus, such as a copying machine, a printer, and a fax machine, which performs image formation by an electrophotographic system.

2. Description of the Related Art

Conventionally, as an image forming apparatus such as a copying machine and a laser beam printer, an image forming apparatus having a configuration which uses an intermediate transfer member is known.

In this image forming apparatus, as a primary transfer process, a toner image formed on a surface of a photosensitive drum serving as an image bearing member is transferred onto an intermediate transfer member by applying a voltage from a voltage source to a primary transfer member arranged at a photosensitive drum opposing portion. After that, the primary transfer process is repeatedly performed for toner images of multiple colors, and thus the toner images of multiple colors are formed on the surface of the intermediate transfer member. Subsequently, as a secondary transfer process, the toner images of multiple colors formed on the surface of the intermediate transfer member are collectively transferred onto a surface of a recording material such as paper by applying a voltage to a secondary transfer member. The collectively transferred toner images are then permanently fixed to the recording material by a fixing unit. Thus, a color image is formed.

Japanese Patent Application Laid-Open No. 2011-232785 employs a configuration as follows. A roller opposing to the a photosensitive drum for primary transfer is formed of a rigid body such as a metal body, the opposing roller abuts against an intermediate transfer belt at a position shifted from a primary transfer portion, and the primary transfer portion is formed by bringing the intermediate transfer belt into contact with (increasing the contact area of the intermediate transfer belt with respect to) the photosensitive drum.

However, the above-mentioned conventional example has the following problem.

The intermediate transfer belt has large stretching characteristics with respect to tension. Therefore, when the intermediate transfer belt is driven to rotate, a stripe-like deformation may be seen on the belt surface in some cases. When this stripe-like belt deformation reaches an image forming portion, irregularities are generated at the primary transfer portion between the photosensitive drum and the intermediate transfer belt in its longitudinal direction. Depending on the place in the longitudinal direction of the primary transfer portion, an air gap is formed between the photosensitive drum and the intermediate transfer belt, which may cause a problem of image failure.

SUMMARY OF THE INVENTION

A purpose of the present invention is to prevent an image failure to be generated by a wrinkle of an intermediate transfer belt.

Another purpose of the present invention is to provide an image forming apparatus, including an image bearing member which bears a toner image; an intermediate transfer member onto which the toner image is primarily transferred from the image bearing member, the intermediate transfer member being movable and having conductivity; multiple stretching members for stretching the intermediate transfer member; a contact member which is arranged between the multiple stretching members and comes into contact with the intermediate transfer member on a side on which a primary transfer surface of the intermediate transfer member is formed, toner images from the multiple image bearing members being primarily transferred to the primary transfer surface between the multiple stretching members; and a voltage maintaining element connected to the contact member. The contact member includes multiple rotary members arranged in a divided manner in a direction orthogonal to a moving direction of the intermediate transfer member.

Still another purpose of the present invention is to provide an image forming apparatus, including multiple image bearing members which bear toner images, respectively; an intermediate transfer member onto which the toner images are primarily transferred from the multiple image bearing members, the intermediate transfer member being movable and having conductivity; multiple stretching members for stretching the intermediate transfer member; and multiple contact members arranged so as to correspond to the multiple image bearing members, respectively, between the multiple stretching members, the multiple contact members being configured to come into contact with the intermediate transfer member. The multiple contact members each include multiple rotary members arranged in a divided manner in a direction orthogonal to a moving direction of the intermediate transfer member. The multiple contact members are each arranged on a downstream side in the moving direction of the intermediate transfer member with respect to a contact portion between the intermediate transfer member and corresponding one of the multiple image bearing members. The intermediate transfer member is protruded on a side of the multiple image bearing members.

Further features of the present invention will become apparent from the following description of exemplary embodiments with reference to the attached drawings.

DESCRIPTION OF THE EMBODIMENTS

In the following, exemplary embodiments of the present invention are illustratively described in detail with reference to the drawings. However, sizes, materials, and shapes of components described in the following embodiments, and their relative positions, are subject to appropriate change in accordance with a configuration and various conditions of an apparatus to which the present invention is applied. Accordingly, as long as there is no specific description, it is not intended to limit the scope of the present invention only to those exemplary embodiments.

First Embodiment

Figure 1:
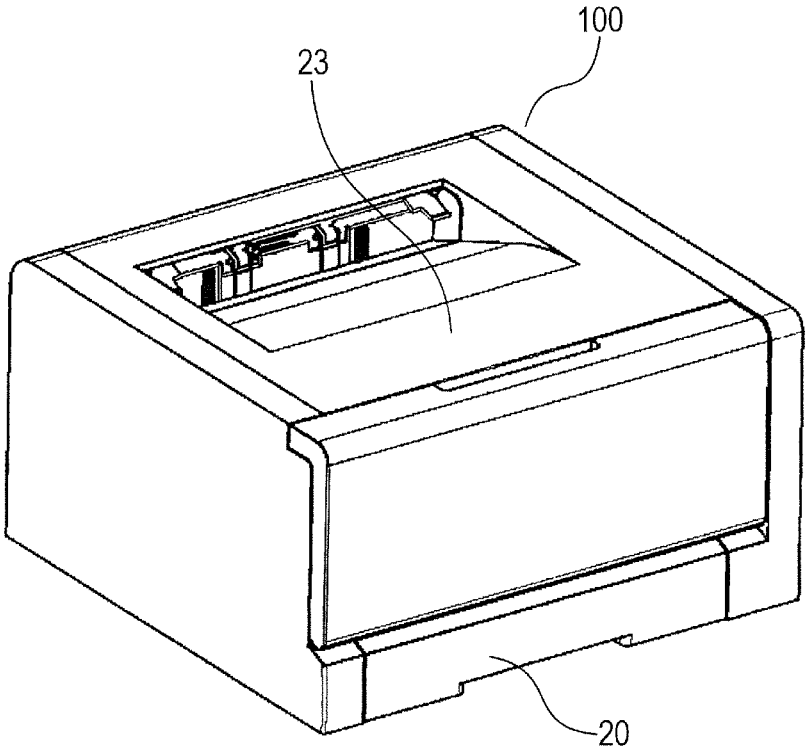
FIG. 1 is a perspective view of an electrophotographic image forming apparatus according to a first embodiment of the present invention.
Figure 2:
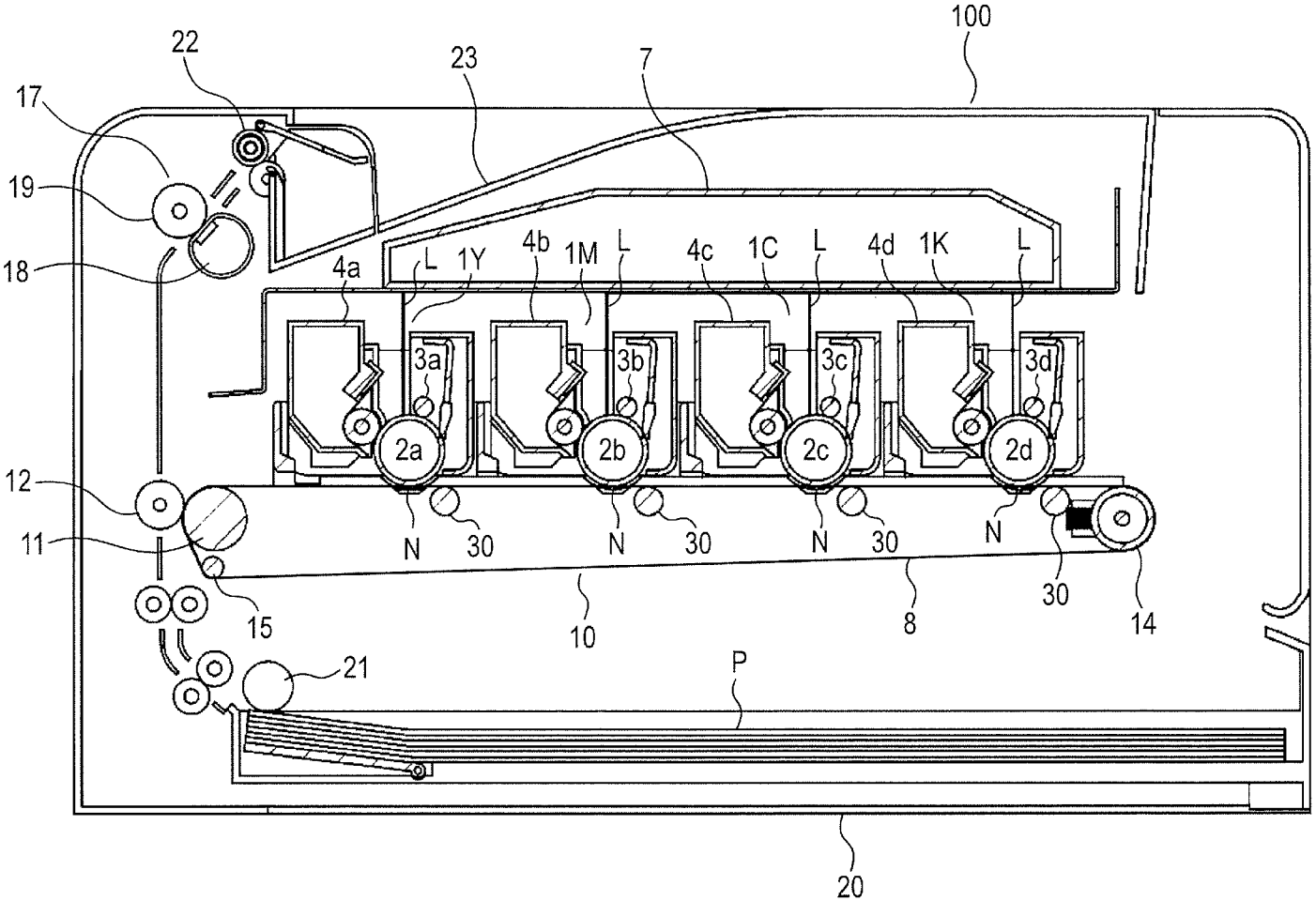
FIG. 2 is a cross-sectional view of the electrophotographic image forming apparatus according to the first embodiment.
Figure 3:
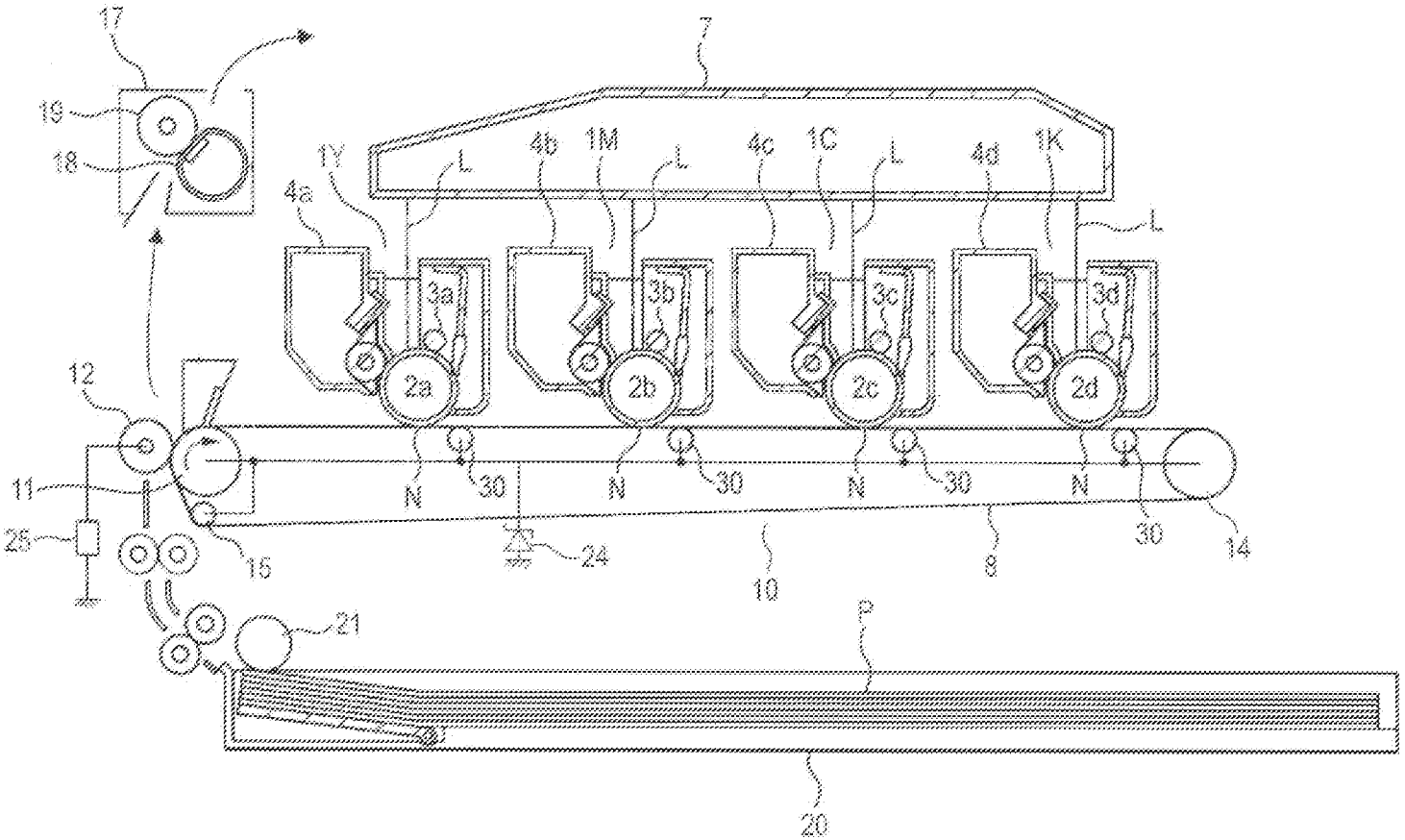
FIG. 3 is a cross-sectional view of the electrophotographic image forming apparatus according to the first embodiment.

With reference to FIGS. 1 to 3, an image forming apparatus according to a first embodiment of the present invention is described. FIG. 1 is a perspective view of the image forming apparatus according to the first embodiment. FIGS. 2 and 3 are schematic cross-sectional views of the electrophotographic image forming apparatus according to the first embodiment. In this case, as the image forming apparatus, an electrophotographic full-color image forming apparatus such as a tandem-type laser printer is exemplified.

As illustrated in FIGS. 1 to 3, inside an image forming apparatus main body 100, there are provided a laser scanner 7 serving as an exposing unit, photosensitive drums 2*a*, 2*b*, 2*c*, and 2*d* each serving as an image bearing member, and developing devices 4*a*, 4*b*, 4*c*, and 4*d*. In addition, inside the image forming apparatus main body 100, there are provided an intermediate transfer belt 8 serving as an intermediate transfer member, a fixing device 17, a feeding tray 20, a feeding roller 21, and the like.

Sheets P serving as recording materials, which are stacked and stored in the feeding tray 20, are fed by the feeding roller 21 which rotates in a clockwise direction of FIG. 2, and are then sent to a nip portion (secondary transfer portion) between a belt drive roller 11 and a secondary transfer roller 12.

The photosensitive drums 2*a*, 2*b*, 2*c*, and 2*d* each serving as the image bearing member rotate in a counter-clockwise direction of FIG. 2, and the surfaces of the photosensitive drums 2*a*, 2*b*, 2*c*, and 2*d* are uniformly charged by charging rollers 3*a*, 3*b*, 3*c*, and 3*d* serving as charging devices, respectively. Then, on respective outer circumferential surfaces of the photosensitive drums 2*a*, 2*b*, 2*c*, and 2*d*, electrostatic latent images are sequentially formed by laser light L from the laser scanner 7 serving as the exposing unit. Subsequently, on the outer circumferential surfaces of the photosensitive drums 2*a*, 2*b*, 2*c*, and 2*d*, the above-mentioned electrostatic latent images are developed by the developing devices 4*a*, 4*b*, 4*c*, and 4*d*, respectively. Thus, toner images are formed.

The toner images formed on the photosensitive drums 2*a*, 2*b*, 2*c*, and 2*d* are transferred onto the intermediate transfer belt 8. When a color image is formed, respective colors of yellow, magenta, cyan, and black are developed on the respective photosensitive drums 2*a*, 2*b*, 2*c*, and 2*d*, and the toner images formed thereon are sequentially transferred onto the intermediate transfer belt 8. That is, the toner images formed on the respective photosensitive drums 2*a*, 2*b*, 2*c*, and 2*d* are transferred onto the intermediate transfer belt 8 at respective primary transfer portions N so as to be superimposed.

Next, the toner images formed on the intermediate transfer belt 8 are transferred onto the sheet P sent to the secondary transfer portion corresponding to the nip portion between the belt drive roller 11 and the secondary transfer roller 12. From a power supply 25 for transfer connected to the secondary transfer roller 12, a voltage is applied to the secondary transfer roller 12. Accordingly, the toner images on the intermediate transfer belt 8 are transferred onto the sheet P. In the case where the color image is formed as described above, the toner images which are superimposed and transferred onto the intermediate transfer belt 8 are collectively transferred onto the sheet P at the secondary transfer portion.

Further, the sheet P having the toner images transferred thereon is sent to a nip portion between a fixing film 18 and a pressure roller 19 in the fixing device 17, and is heated and pressurized to fix the toner images on the sheet P.

The sheet P having the toner images fixed thereon is delivered by a delivery roller pair 22 to a delivery tray 23.

The photosensitive drums 2*a*, 2*b*, 2*c*, and 2*d* of this embodiment are removably mounted to the image forming apparatus main body 100 as process cartridges 1Y, 1M, 1C, and 1K in which the photosensitive drums 2*a*, 2*b*, 2*c*, and 2*d* are integrated with the charging rollers 3*a*, 3*b*, 3*c*, and 3*d* and the developing devices 4*a*, 4*b*, 4*c*, and 4*d*, which serve as process units acting thereto, respectively.

Also in this embodiment, similarly to the above-mentioned conventional image forming apparatus, the photosensitive drums 2*a*, 2*b*, 2*c*, and 2*d* of the process cartridges 1Y, 1M, 1C, and 1K corresponding to the toner with colors of yellow, magenta, cyan, and black, respectively, are provided as the image bearing members. The intermediate transfer belt 8 is a belt-like intermediate transfer member movably stretched by rollers 11, 14, and 15 serving as multiple stretching members. The intermediate transfer belt 8 comes into contact with the photosensitive drums 2*a*, 2*b*, 2*c*, and 2*d* at respective primary transfer portions N. The four photosensitive drums 2*a*, 2*b*, 2*c*, and 2*d* are arranged in a line at predetermined regular intervals in the moving direction of the intermediate transfer belt 8.

In the following, a configuration of the primary transfer portion of this embodiment is described.

In this embodiment, as illustrated in FIG. 3, a contact surface (primary transfer surface) between the intermediate transfer belt 8 and the photosensitive drums 2*a*, 2*b*, 2*c*, and 2*d* is formed by the belt drive roller 11 and the tension roller 14. Further, between the belt drive roller 11 and tension roller 14, contact members 30 are arranged, which come into contact with the intermediate transfer belt 8 on the side of the primary transfer surface on which the toner images are primarily transferred from the photosensitive drums 2*a*, 2*b*, 2*c*, and 2*d*. In this embodiment, the contact members 30 are multiple transfer rotary members 30 arranged at positions corresponding to the photosensitive drums 2*a*, 2*b*, 2*c*, and 2*d*, respectively.

Then, the multiple transfer rotary members 30, the belt drive roller 11, and the tension roller 14 are connected to a voltage maintaining element 24. The transfer rotary members 30 form the primary transfer portions (primary transfer nip portions) N between the intermediate transfer belt 8 and the corresponding photosensitive drums 2*a*, 2*b*, 2*c*, and 2*d*, respectively.

The intermediate transfer belt 8 is an endless belt having conductivity, which is obtained by adding a conductive agent to a resin material, and is tensioned by three axes of the belt drive roller 11, the tension roller 14, and stretching roller 15 serving as the multiple stretching members. The intermediate transfer belt 8 is tensioned at a predetermined tension by the tension roller 14. The intermediate transfer belt 8 is driven to rotate at the primary transfer portion N at substantially the same circumferential speed as the photosensitive drums 2*a*, 2*b*, 2*c*, and 2*d* in the same moving direction as the photosensitive drums 2*a*, 2*b*, 2*c*, and 2*d*.

Figure 4A:
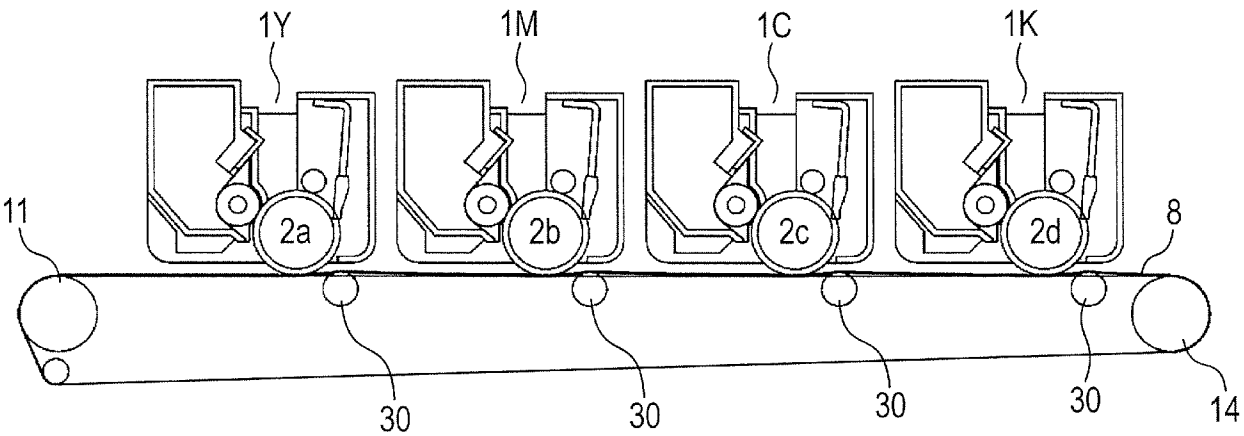
FIG. 4A is a cross-sectional view illustrating a relationship of a photosensitive drum and a primary transfer rotary member according to the first embodiment.

As illustrated in FIG. 4A, in each image forming station (image forming portion), on a surface of the intermediate transfer belt 8 on a side opposite to the surface with which the respective photosensitive drums 2*a*, 2*b*, 2*c*, and 2*d* come into contact, the transfer rotary members 30 are arranged so as to correspond to the photosensitive drums 2*a*, 2*b*, 2*c*, and 2*d*, respectively. Each of the transfer rotary members 30 is arranged so as to come into contact with the intermediate transfer belt 8 on a downstream side in the moving direction of the intermediate transfer belt 8 by a predetermined amount with respect to a contact portion between the intermediate transfer belt 8 and the photosensitive drums 2*a*, 2*b*, 2*c*, and 2*d*.

Figure 4B:
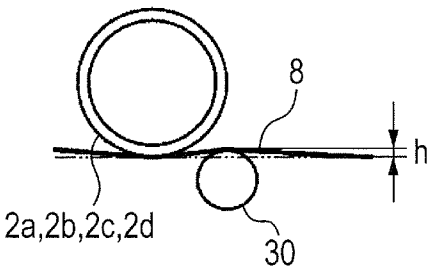
FIG. 4B is an enlarged view of a part including the photosensitive drum and the primary transfer rotary member of FIG. 4A.

Further, as illustrated in FIG. 4B, each of the transfer rotary members 30 is arranged at a position raised by a distance h (position protruding on the photosensitive drum side) with respect to a horizontal surface formed between the intermediate transfer belt 8 and the photosensitive drums 2*a*, 2*b*, 2*c*, and 2*d*. With this, the transfer rotary members 30 each secure a predetermined contact area of the intermediate transfer belt 8 with respect to the corresponding photosensitive drums 2*a*, 2*b*, 2*c*, and 2*d* so that the respective photosensitive drums 2*a*, 2*b*, 2*c*, and 2*d* and the intermediate transfer belt 8 form the primary transfer nip portions (primary transfer portions N).

With the configuration described above, the respective transfer rotary members 30 form the primary transfer portions N between the respective photosensitive drums 2*a*, 2*b*, 2*c*, and 2*d* and the intermediate transfer belt 8. Further, the contact area of the intermediate transfer belt 8 with respect to each of the photosensitive drums 2*a*, 2*b*, 2*c*, and 2*d* is increased, and thus the photosensitive drums 2*a*, 2*b*, 2*c*, and 2*d* and the intermediate transfer belt 8 can be more surely brought into contact with each other. Further, the surfaces of the photosensitive drums 2*a*, 2*b*, 2*c*, and 2*d* are not damaged even when the transfer rotary members 30 are rigid members, such as metal rollers.

The respective members 11, 14, 15, and 30, to which the voltage maintaining element 24 is connected, are maintained at a predetermined potential or higher by a current which flows from the secondary transfer roller 12 serving as the current supply member to the voltage maintaining element 24 via the intermediate transfer belt 8. The predetermined potential is a potential which is set so that a primary transfer potential, which can achieve a desired transfer efficiency, can be maintained at the respective primary transfer portions N.

In this embodiment, as the voltage maintaining element 24, a Zener diode 24, which is a constant voltage element, is used. A Zener voltage is hereinafter defined as a voltage which is applied between an anode and a cathode when a voltage is applied to the Zener diode in a reverse direction. Note that, a varistor may be used as the constant voltage element.

When the Zener diode 24 is used as the voltage maintaining element, an absolute value of the Zener voltage of the Zener diode 24 only needs to be set to a predetermined potential or higher. In this embodiment, the predetermined potential is set to 150 V, and the Zener voltage is set to 300 V as the voltage for maintaining the predetermined potential or higher.

When the voltage is applied from the power supply 25 for transfer to the secondary transfer roller 12, a current flows from the secondary transfer roller 12 to the grounded Zener diode 24 via the intermediate transfer belt 8 and the belt drive roller 11. At this time, the Zener diode 24 allows the current to flow from the cathode side to the anode side so as to create a state in which a voltage is applied in the reverse direction. The anode side of the Zener diode 24 is grounded, and hence the cathode side of the Zener diode 24 is maintained at the Zener voltage. Accordingly, the belt drive roller 11, which is connected to the cathode side of the Zener diode 24, is maintained at 300 V.

Further, the transfer rotary members 30 are connected to the Zener diode 24, and hence are maintained at 300 V similarly to the belt drive roller 11. As described above, by applying a voltage from the power supply 25 for transfer to the secondary transfer roller 12, a current flows through the Zener diode 24 via the secondary transfer roller 12, the intermediate transfer belt 8, and the belt drive roller 11. When a current of a predetermined amount or more flows, the cathode side of the Zener diode 24 is maintained at the Zener voltage, and hence the transfer rotary member 30 is also maintained at a predetermined potential or higher. The transfer rotary member 30 is maintained at the predetermined potential or higher, and hence fluctuations in potential at each primary transfer portion N can be suppressed, and sufficient primary transfer ability can be secured.

That is, the potential can be created at the transfer rotary members 30 only by applying a voltage from the power supply 25 for transfer to the secondary transfer roller 12 without applying a voltage from a power supply for primary transfer to the transfer rotary members 30. The rollers 14 and 15 are also connected to the Zener diode 24, and hence are similarly maintained at a predetermined potential or higher. Note that, the rollers 14 and 15 may not be connected to the Zener diode 24 and be electrically insulated.

In this embodiment, the belt drive roller 11 (opposing member) opposed to the secondary transfer roller 12 (current supply member) is connected to the Zener diode 24, and hence even when the primary transfer and the secondary transfer are simultaneously performed, the fluctuations in potential at each primary transfer portion N can be suppressed. This is because, in a case where the current supplied from the secondary transfer roller 12 changes for maintaining the secondary transfer ability, the excessively flowing electric current flows to the ground side via the Zener diode 24, and hence the potential of the primary transfer portion N is hardly affected therefrom.

Note that, the intermediate transfer belt 8 is integrated as an intermediate transfer belt unit 10 together with the belt drive roller 11, the tension roller 14, and the stretching roller 15 serving as the multiple stretching members, and the transfer rotary members 30 as the primary transfer members. The intermediate transfer belt unit 10 is removably mounted to the image forming apparatus main body 100.

Next, with reference to FIGS. 5A to 5E and 6, a structure of the transfer rotary member 30 is described. FIGS. 5A to 5E and 6 illustrate the structure of the transfer rotary member 30.

As illustrated in FIGS. 5A to 5E, the transfer rotary member 30 is formed of rotary members 32 to 35 (seven rotary members in this embodiment) serving as multiple rotary members, which are arranged in a divided manner in an axial direction. With use of the multiple rotary members 32 to 35 as described above, the individual rotary members 32 to 35 provided in a divided manner are rotatably held on a primary transfer rotary member shaft 31. The transfer rotary member 30 is not limited to include seven rotary members as in this embodiment, and the number of the rotary members may be increased or decreased as appropriate. Further, axial lengths and outer diameters of the rotary members 32 to 35 need not be the same.

As described above, the multiple rotary members 32 to 35 included in the transfer rotary member 30 are rotatably held on the primary transfer rotary member shaft 31. Therefore, a part of the transfer rotary member 30, which comes into contact with the intermediate transfer belt 8, is independently rotated in accordance with the movement of the intermediate transfer belt 8.

As illustrated in FIGS. 5A to 5E, the intermediate transfer belt 8 is more likely to stretch in the vicinity of the center portion in the width direction orthogonal to the conveying direction of the intermediate transfer belt 8 than at edge portions thereof, and hence in order to correct this difference and eliminate the wrinkle more efficiently, it is effective to set the outer diameter of the transfer rotary member 30 in the vicinity of the center portion larger than the outer diameter of the rotary member at the edge portion.

Figure 5A:
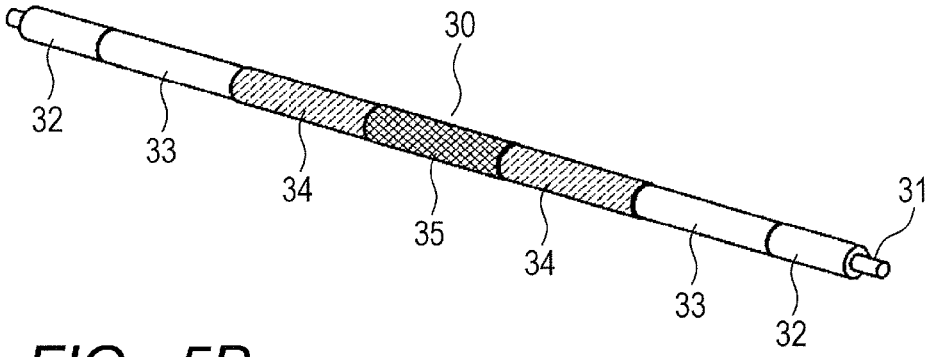
FIG. 5A is a perspective view of the primary transfer rotary member according to the first embodiment.
Figure 5B:
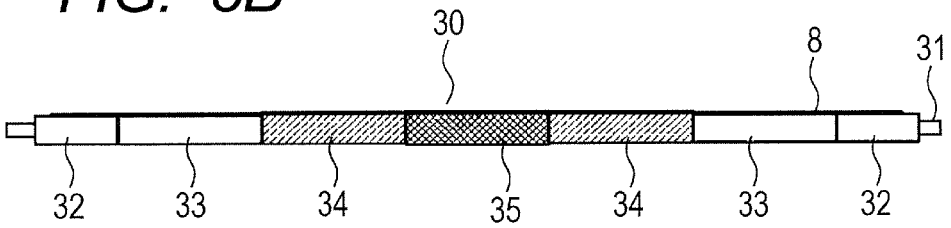
FIG. 5B is a front view of the primary transfer rotary member.
Figure 5C:
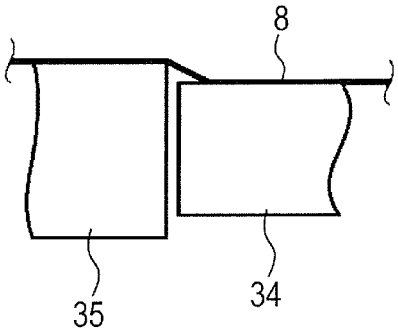
FIGS. 5C, 5D, and 5E are enlarged views of the primary transfer rotary member.
Figure 5D:
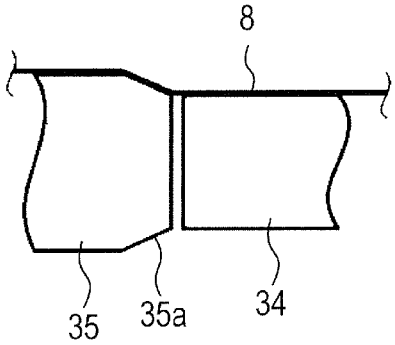
Figure 5E:
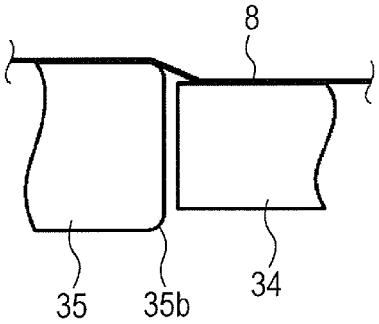

As illustrated in FIG. 5C, at a position where a step is generated, such as positions of the rotary members 34 and 35 which are different in outer diameter from one another, the intermediate transfer belt 8 is bent at an edge portion between the rotary members, and thus stress is concentrated to deform the intermediate transfer belt 8 to be stripe-like. Therefore, in order to reduce the stress at the bending point of the intermediate transfer belt 8 and relieve the stress of the intermediate transfer belt 8, it is desired that at least the edge portion of the larger-outer-diameter rotary member 35 adjacent to the smaller-outer-diameter rotary member 34 be formed into an inclined surface shape 35*a* as illustrated in FIG. 5D and a round shape 35*b* as illustrated in FIG. 5E.

Figure 6:
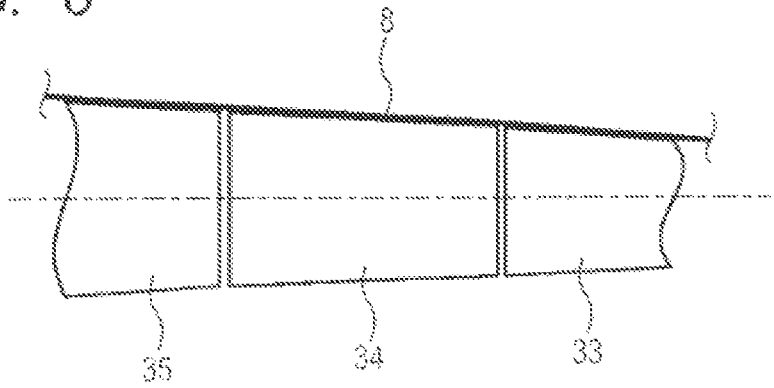
FIG. 6 is an explanatory view of a main part of a modification example of the primary transfer rotary member according to the first embodiment.

Further, as illustrated in FIG. 6, in order to reduce parts at which the stress concentrates, which correspond to bending points generated at gaps and steps between the multiple rotary members 32 to 35 forming the transfer rotary member 30, the entire width is desired to be formed into a tapered shape. As described above, in order to further reduce the stress concentration caused by the bending of the intermediate transfer belt 8 due to the step at the edge portions of the rotary members 32 to 35, the edge portions of the rotary members 32 to 35 may be formed into an inclined surface shape or a round shape.

In this embodiment, the intermediate transfer belt 8 having a surface resistivity of $1\times10^9$ Ω/square, ohms per square was used. The surface resistivity was measured by a Hiresta-UP (MCP-HT450) manufactured by Mitsubishi Chemical Corporation using a ring probe type UR-100 (mode number: MCP-HTP16). The room temperature and the room humidity during measurement were set to 23° C. and 50%, respectively, and conditions of the application voltage and the measurement time were set to 100 V and 10 sec, respectively.

Figure 7A:
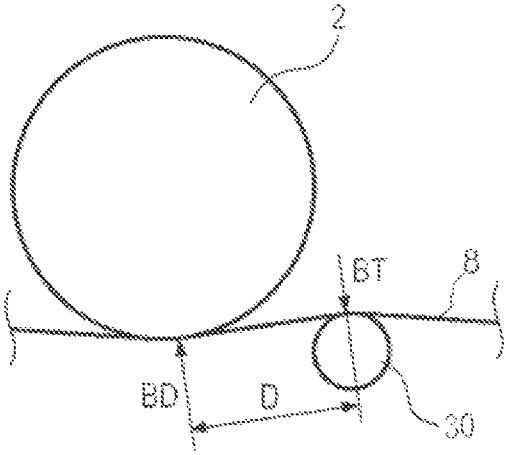
FIG. 7A is a cross-sectional view illustrating a relationship of the photosensitive drum, an intermediate transfer belt, and the primary transfer rotary member according to the first embodiment.
Figure 7B:
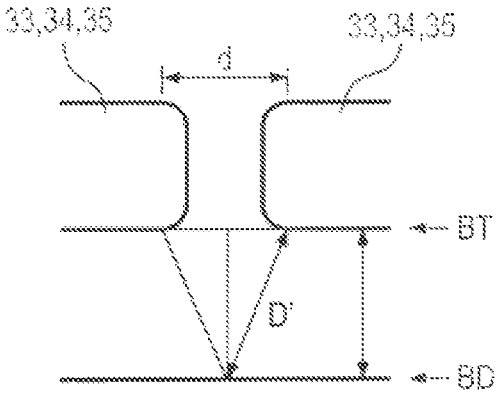
FIG. 7B is a view illustrating a non-contact portion at which the intermediate transfer belt does not come into contact with the primary transfer rotary member.

By the way, it is necessary to consider the influence of gaps between the rotary members 33 to 35 of each transfer rotary member 30 on transfer ability. The electric resistance increases in proportion to distance, and hence resistance unevenness is generated in the longitudinal direction of a photosensitive drum 2 by the gaps in each transfer rotary member 30. Considering the transfer ability from the photosensitive drum 2 to the intermediate transfer belt 8, it is preferred that the resistance unevenness in the longitudinal direction of the photosensitive drum 2 be set to 20% or lower. Therefore, as illustrated in FIGS. 7A and 7B, the following expression is satisfied:

$$D'=\sqrt{(D^2+(d/2)^2)}<1.2D$$

where D represents a distance on a surface of the intermediate transfer belt 8 from a separation portion (BD) between the photosensitive drum 2 and the intermediate transfer belt 8 to a separation portion (BT) between the transfer rotary member 30 and the intermediate transfer belt 8, and d represents a width of a non-contact portion at which the intermediate transfer belt 8 does not come into contact with the rotary members 33 to 35 of the transfer rotary member 30.

In this embodiment, the rotary members 33 to 35 of the transfer rotary member 30 are arranged so that D=7 and d≤3 are satisfied.

Note that, the above-mentioned conditions merely indicate an example of the present invention, and do not limit the embodiments of the present invention.

As described above, the transfer rotary member 30 is divided in its longitudinal direction, and the multiple rotary members 32 to 35, which are different in outer diameter from one another, are arranged so that the intermediate transfer belt 8 is protruded on the outer side (photosensitive drum 2 side). With this, a wrinkle of the intermediate transfer belt 8 is prevented at the primary transfer portion N, and a stable contact state between the photosensitive drum 2 and the intermediate transfer belt 8 can be maintained. Thus, the image failure to be caused by the wrinkle of the intermediate transfer belt 8 can be prevented.

Further, as the primary transfer member, a metal shaft and resin rotary members provided thereon may be used. Accordingly, the configuration for reducing the wrinkle of the intermediate transfer belt can be achieved at low cost.

Second Embodiment

In this embodiment, a modification example of the contact member is described. Note that, in this embodiment, a structure different from that of the above-mentioned first embodiment is described.

Figure 8A:
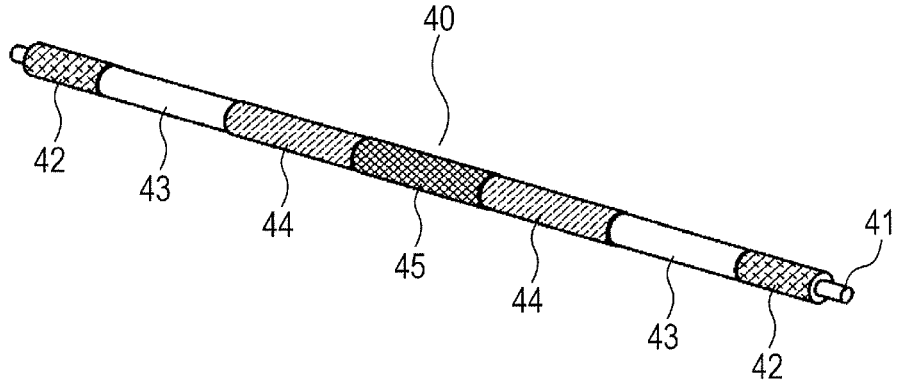
FIG. 8A is a perspective view of a primary transfer rotary member according to a second embodiment of the present invention.
Figure 8B:
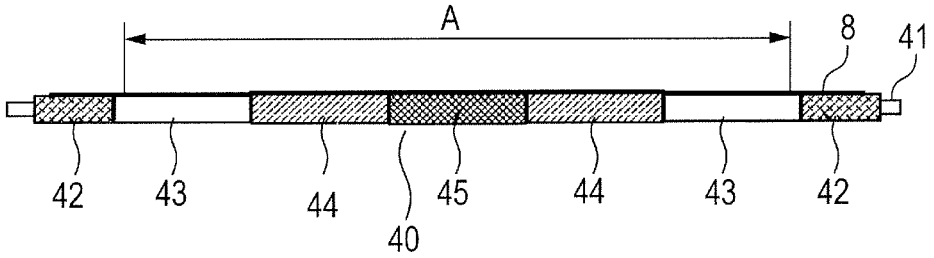
FIGS. 8B and 8C are front views of the primary transfer rotary member according to the second embodiment.
Figure 8C:
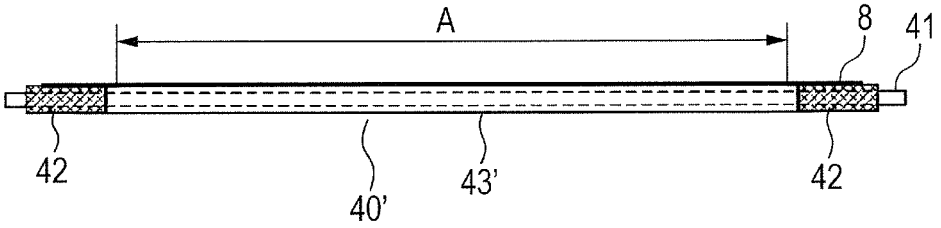
Figure 11:
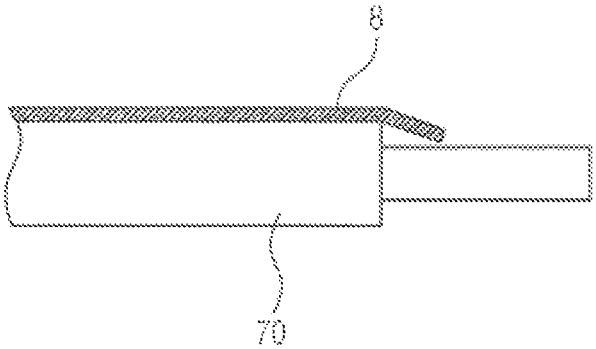
FIG. 11 (PRIOR ART)
FIG. 11 is an explanatory view illustrating a relationship between an intermediate transfer belt and a stretching roller of a conventional example.

FIGS. 8A, 8B, and 8C illustrate a structure of a transfer rotary member 40 serving as the transfer rotary member 40 according to this embodiment. The transfer rotary member 40 includes a primary transfer rotary member shaft 41 and is set longer than the intermediate transfer belt 8 in the width direction orthogonal to the moving direction of the intermediate transfer belt 8. As illustrated in FIG. 11, when the intermediate transfer belt 8 is tensioned around a stretching roller 70 that is shorter than the intermediate transfer belt 8 in the width direction, the intermediate transfer belt 8 is bent at an edge portion of the stretching roller 70, which causes damage to the intermediate transfer belt 8. Therefore, as illustrated in FIGS. 8A and 8B, the transfer rotary member 40 is set wider than the intermediate transfer belt 8 in the width direction orthogonal to the moving direction of the intermediate transfer belt 8.

Accordingly, the edge portion of the intermediate transfer belt 8 in the width direction is not bent so that the damage to the intermediate transfer belt 8 can be prevented.

Similarly to the above-mentioned embodiment, the transfer rotary member 40 is formed of rotary members 42 to 45 serving as multiple rotary members, which are arranged in a divided manner in the width direction of the intermediate transfer belt 8 and are different in outer diameter from one another. Further, the transfer rotary member 40 is electrically connected to the voltage maintaining element 24, and a potential necessary for the primary transfer is applied to the transfer rotary member 40.

Therefore, in this embodiment, as illustrated in FIGS. 8A and 8B, in a range of at least an image region A of the transfer rotary member 40, the transfer rotary member 40 is formed of conductive rotary members 43 to 45 that are rigid conductive members. On the other hand, in a range of a non-image region other than the image region A, no current flow is necessary in terms of the image formation, and hence, in a region ranging from the edge portions of the image region A to the edge portions of the intermediate transfer belt 8 (that is, region outside the image region), the transfer rotary member 40 is formed of insulating rotary members 42 that are insulating members. Accordingly, it is possible to suppress leakage of a current flowing between the photosensitive drums 2*a*, 2*b*, 2*c*, and 2*d* and the respective transfer rotary members 40 through the region outside the image region, and to achieve further cost reduction than in a case where all the rotary members of the transfer rotary member 30 are formed of conductive members 32 to 35.

Further, as illustrated in FIG. 8C, there may be employed a transfer rotary member 40' including a single conductive rotary member 43' arranged in the range of the image region A that requires the conductivity. The conductive rotary member 43' has a larger outer diameter at the center portion in the width direction than at the edge portions. In this case, the shape of the conductive rotary member 43' is not limited to a tapered shape in which the outer diameter changes in a linear manner, but may be a drum shape in which the outer diameter changes in a curved manner.

Further, similarly to the above-mentioned embodiment, it is desired that an inclined surface shape or a round shape be provided at the edge portions of the conductive rotary member 43' and the insulating rotary member 42 located outside the image region A so as to reduce the stress concentration occurring in the intermediate transfer belt 8 due to the step generated in the gap between the conductive rotary member 43' and the insulating rotary member 42.

As described above, according to this embodiment, the following effects can be obtained in addition to the effects of the above-mentioned first embodiment. That is, the transfer rotary member 40 is set longer than the intermediate transfer belt 8 in the width direction orthogonal to the moving direction of the intermediate transfer belt 8. As a result, the edge portion of the intermediate transfer belt 8 in the width direction is not bent so that the damage to the intermediate transfer belt 8 can be prevented. Moreover, the rotary members 42 of the transfer rotary member 40 which are located outside the image region A of the intermediate transfer belt 8 are formed of the insulating members. As a result, it is possible to suppress the leakage of a current flowing between the photosensitive drums 2*a*, 2*b*, 2*c* and 2*d* and the transfer rotary member 40 through the region outside the image region A. Accordingly, the improvement in image quality, the prevention of damage to the edge portion of the intermediate transfer belt 8, and the cost reduction can be achieved.

Third Embodiment

In this embodiment, a modification example of the contact member is described. Note that, in this embodiment, a structure different from that of the above-mentioned second embodiment is described.

Figure 9A:
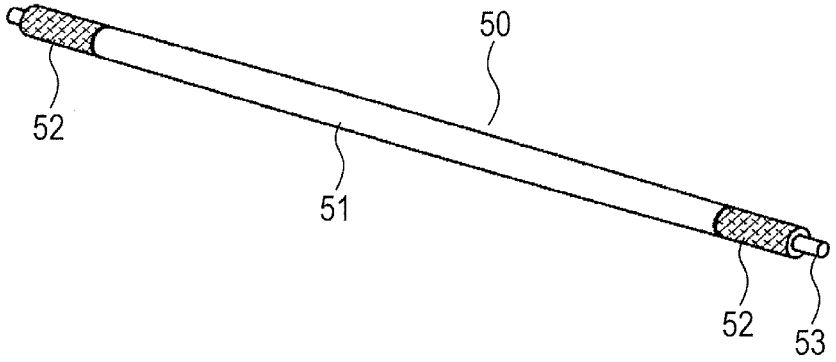
FIG. 9A is a perspective view of a primary transfer rotary member according to a third embodiment of the present invention.
Figure 9B:
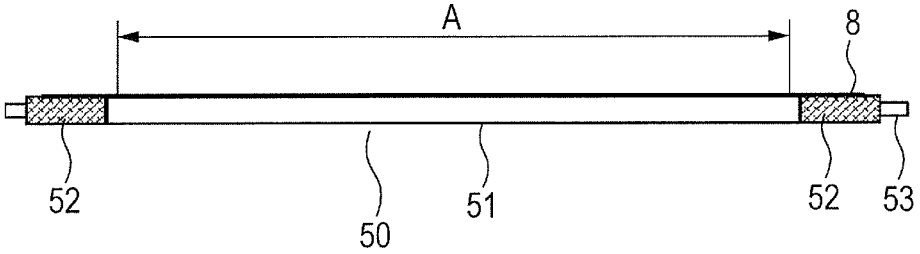
FIG. 9B is a front view of the primary transfer rotary member.

FIGS. 9A and 9B illustrate a structure of a transfer roller 50 serving as the contact member according to this embodiment. The transfer roller 50 is set longer than the intermediate transfer belt 8 in the width direction orthogonal to the moving direction of the intermediate transfer belt 8. As illustrated in FIG. 11, when the intermediate transfer belt 8 is tensioned around the stretching roller 70 that is shorter than the intermediate transfer belt 8 in the width direction, the intermediate transfer belt 8 is bent at the edge portion of the stretching roller 70, which causes damage to the intermediate transfer belt 8. Therefore, as illustrated in FIGS. 9A and 9B, the transfer roller 50 is set wider than the intermediate transfer belt 8 in the width direction orthogonal to the moving direction of the intermediate transfer belt 8. Accordingly, the edge portion of the intermediate transfer belt 8 in the width direction is not bent so that the damage to the intermediate transfer belt 8 can be prevented.

Similarly to the above-mentioned embodiments, the transfer roller 50 is electrically connected to the voltage maintaining element 24, and a potential necessary for the primary transfer is applied to the transfer roller 50. Therefore, the transfer roller 50 is formed of a conductive metal roller 51 in a range of at least an image region A of the transfer roller 50.

Further, the metal roller 51 has a crowned shape in which the outer diameter is larger at the center portion in the width direction of the intermediate transfer belt 8 than at the edge portions. Accordingly, the wrinkle of the intermediate transfer belt 8 at the primary transfer portion N can be reduced so that the stable contact state between the photosensitive drums 2*a*, 2*b*, 2*c* and 2*d* and the intermediate transfer belt 8 can be maintained.

On the other hand, in a range of the non-image region other than the image region A, no current flow is necessary in terms of the image formation, and hence, in a region ranging from the edge portions of the image region A to the edge portions of the intermediate transfer belt 8 (that is, region outside the image region A), the transfer roller 50 is formed of insulating rotary members 52 that are insulating members. Accordingly, it is possible to suppress the leakage of a current flowing between the photosensitive drums 2*a*, 2*b*, 2*c*, and 2*d* and the respective transfer rollers 50 through the region outside the image region A.

Note that, the metal roller 51 is fixed to a roller shaft 53, and the insulating rotary members 52 are rotatably held on the roller shaft 53.

As described above, according to this embodiment as well, effects similar to those of the above-mentioned second embodiment can be obtained. That is, the transfer roller 50 is set longer than the intermediate transfer belt 8 in the width direction orthogonal to the moving direction of the intermediate transfer belt 8. As a result, the edge portion of the intermediate transfer belt 8 in the width direction is not bent so that the damage to the intermediate transfer belt 8 can be prevented. Moreover, the rotary members 52 of the transfer roller 50 which are located outside the image region A of the intermediate transfer belt 8 are formed of the insulating members. As a result, it is possible to suppress the leakage of a current flowing between the photosensitive drums 2*a*, 2*b*, 2*c* and 2*d* and the primary transfer roller 50 through the region outside the image region. Accordingly, the improvement in image quality, the prevention of damage to the edge portion of the intermediate transfer belt 8, and the cost reduction can be achieved.

Fourth Embodiment

Next, an image forming apparatus according to a fourth embodiment of the present invention is described with reference to FIG. 10. A structure different from those of the above-mentioned embodiments is mainly described. Further, members having the same functions as those of the above-mentioned embodiments are represented by the same reference symbols, and description thereof is therefore omitted herein.

Figure 10:
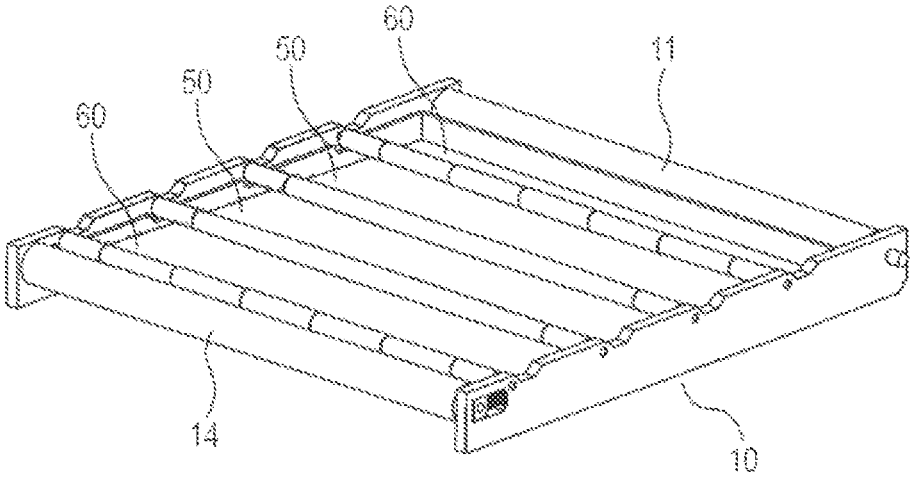
FIG. 10 is a perspective view of an intermediate transfer belt unit according to a fourth embodiment of the present invention.

For convenience of the description, FIG. 10 illustrates the intermediate transfer belt unit 10 on the assumption that the intermediate transfer belt 8 is present in transparent view. As described above, in the intermediate transfer belt unit 10 in the tandem system, the process cartridges 1Y, 1M, 1C, and 1K corresponding to yellow, magenta, cyan, and black are arranged at predetermined intervals for color image formation, and images developed in the respective process cartridges 1Y, 1M, 1C, and 1K are sequentially transferred onto the intermediate transfer belt 8.

In this structure, as the primary transfer members corresponding to the image forming stations (1Y and 1K) which are close to the belt drive roller 11 and the tension roller 14, respectively, there are provided primary transfer rotary members 60 formed of insulating rotary members serving as multiple insulating members which are different in outer diameter from one another. Each of the rotary members forming the primary transfer rotary members 60 rotates in accordance with the movement of the intermediate transfer belt 8. On the other hand, as the primary transfer members corresponding to the image forming stations (1M and 1C) which are spaced apart from the belt drive roller 11 and the tension roller 14, respectively, the transfer rollers 50 described in the third embodiment are provided.

The voltage maintaining element 24 (see FIG. 3) provided to the image forming apparatus main body 100 is electrically connected to the belt drive roller 11, the tension roller 14, and the transfer rollers 50, and the potentials to be applied thereto are maintained at the same level. For the image forming stations (1Y and 1K) which are close to the belt drive roller 11 and the tension roller 14, a voltage necessary for the primary transfer is supplied from the belt drive roller 11 and the tension roller 14, respectively.

Therefore, in order to stabilize the contact at the primary transfer portions N between the photosensitive drums 2*a*, 2*b*, 2*c*, and 2*d* and the intermediate transfer belt 8, the primary transfer rotary members 60 formed of the insulating members are provided as the primary transfer members corresponding to the image forming stations (1Y and 1K) which are close to the belt drive roller 11 and the tension roller 14, respectively.

Accordingly, for the image forming stations (1Y and 1K) to which the voltage is to be supplied from the stretching rollers (11 and 14) in the vicinity thereof, the primary transfer rotary members 60 formed of inexpensive insulating members are used so that the configuration for the primary transfer can be reduced in cost. When the primary transfer rotary members 60 formed of the insulating members are used, there is no electrical restriction on the primary transfer portions N as described in the first embodiment, and hence it is only necessary that the number and shape of the rotary members forming the primary transfer rotary members 60 including the insulating members be such a number and shape as to reduce the wrinkle of the intermediate transfer belt 8 at the primary transfer portions N and to prevent the stress concentration due to the bending of the intermediate transfer belt 8.

Further, the wrinkle is liable to be generated in the intermediate transfer belt 8 particularly at the starting point and the end point of rolling the intermediate transfer belt 8 around the belt drive roller 11 and the tension roller 14. Therefore, the primary transfer rotary members 60 formed of the multiple rotary members which are different in outer diameter from one another are provided as the primary transfer members corresponding to the image forming stations (1Y and 1K) which are close to the belt drive roller 11 and the tension roller 14, respectively. Accordingly, it is possible to facilitate the reduction of the wrinkle at the primary transfer portions N formed between the photosensitive drums 2*a*, 2*b*, 2*c* and 2*d* and the intermediate transfer belt 8.

Further, if the influence of the wrinkle of the intermediate transfer belt 8 is not significant, the primary transfer members corresponding to the image forming stations (1M and 1C) which are spaced apart from the belt drive roller 11 and the tension roller 14, respectively, may have a shape other than the crowned shape that projects at the center, to thereby change the settings of the outer diameters of the primary transfer members.

Further, in this structure, of the primary transfer members arrayed for the four colors, the primary transfer members corresponding to the image forming stations (1Y and 1K) which are close to the belt drive roller 11 and the tension roller 14, respectively, are the primary transfer members formed of the insulating members, but the present invention is not limited thereto. If there is no influence on the image formation, the primary transfer members corresponding to the image forming stations (1M and 1C) which are spaced apart from the belt drive roller 11 and the tension roller 14, respectively, may be formed of the insulating members.

Other Embodiments

Figure 12:
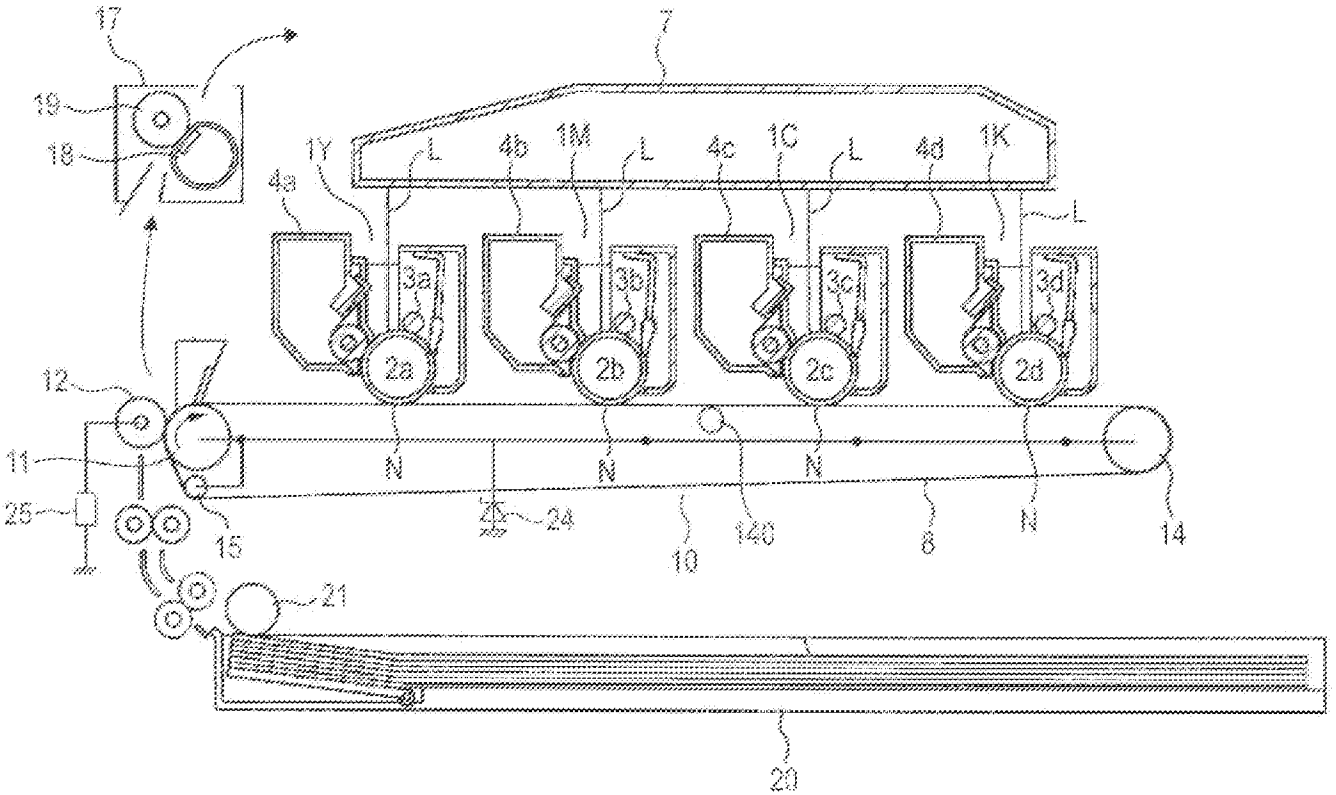
FIG. 12 is an explanatory view illustrating an image forming apparatus according to another embodiment of the present invention.

Further, in the structures described in the above-mentioned embodiments, each contact member is arranged on the downstream side in the belt moving direction with respect to the primary transfer portion formed between the corresponding photosensitive drum and the intermediate transfer belt, but if there is no influence on the image formation, the number of contact members may be reduced. For example, the present invention is also applicable to a contact member 140 of an image forming apparatus illustrated in FIG. 12.

Further, in the structures described in the above-mentioned embodiments, the four-color process cartridges are arranged at regular intervals with respect to the intermediate transfer member, but the process cartridges are not limited to the four-color process cartridges, and the intervals of the respective process cartridges are not necessarily the regular intervals.

Moreover, in the above-mentioned embodiments, the configuration including the four image forming portions is exemplified, but the number of the image forming portions to be used is not limited thereto, and can be suitably set as needed.

Moreover, in the above-mentioned embodiments, as a process cartridge which is removably mounted to the image forming apparatus, the process cartridge integrally including the photosensitive drum, and a charging device, a developing device, and a cleaning device, as the process units acting on the photosensitive drum, is exemplified. However, the process cartridge is not limited thereto. For example, the process cartridge may integrally include, in addition to the photosensitive drum, any one of the charging device, the developing device, and the cleaning device.

Further, in the above-mentioned embodiments, the configuration in which the process cartridge including the photosensitive drum is removably mounted to the image forming apparatus main body is exemplified, but this is not the only case. For example, the image forming apparatus may have a configuration in which respective components, such as the photosensitive drums, are each incorporated into the apparatus main body, or a configuration in which respective components are each removably mounted to the apparatus main body.

Moreover, in the above-mentioned embodiments, the printer is exemplified as the image forming apparatus, but the present invention is not limited thereto. For example, the image forming apparatus may be a copying machine, a facsimile machine, and the like, or a multifunctional peripheral in which functions thereof are combined. As long as the image forming apparatus includes an intermediate transfer unit as described above, similar advantageous effects can be obtained by applying the present invention to these image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-085307, filed Apr. 4, 2012, which is hereby incorporated by reference herein in its entirety.

What is claimed is:

1. An image forming apparatus, comprising:

an image bearing member which bears a toner image;

an endless intermediate transfer member onto which the toner image is primarily transferred from the image bearing member, the intermediate transfer member being movable and having conductivity;

multiple stretching members for stretching the intermediate transfer member;

a contact member which is arranged between the multiple stretching members and comes into contact with an inner circumferential surface of the intermediate transfer member; and a voltage maintaining element connected to the contact member, wherein the contact member includes multiple rotary members into which the contact member is divided in a direction orthogonal to a moving direction of the intermediate transfer member.

2. An image forming apparatus according to claim 1, wherein the contact member includes a shaft, and wherein the multiple rotary members are rotatable about the shaft.

3. An image forming apparatus according to claim 2, wherein among the multiple rotary members, a rotary member at a center portion in the direction orthogonal to the moving direction of the intermediate transfer member has an outer diameter larger than an outer diameter of a rotary member at an edge portion.

4. An image forming apparatus according to claim 1, wherein one or more multiple rotary members which contact the intermediate transfer member among the multiple rotary members rotates in association with movement of the intermediate transfer member.

5. An image forming apparatus according to claim 1, wherein a length of the contact member is longer than a length of the intermediate transfer member in a direction orthogonal to a moving direction of the intermediate transfer member.

6. An image forming apparatus according to claim 5, wherein the contact member includes a rotary member formed of a conductive member in a range of an image region of the intermediate transfer member, and comprises a rotary member formed of an insulating member outside the image region.

7. An image forming apparatus according to claim 6, wherein the conductive member includes a metal roller having a larger outer diameter at a center portion in the direction orthogonal to the moving direction of the intermediate transfer member than at edge portions, and wherein the insulating member comprises a rotary member which rotates in accordance with movement of the intermediate transfer member.

8. An image forming apparatus according to claim 1, further including a current supply member which comes into contact with the intermediate transfer member and supplies a current to the intermediate transfer member, wherein the contact member is maintained at a predetermined potential or higher by the current flowing from the current supply member to the intermediate transfer member.

9. An image forming apparatus according to claim 8, wherein the intermediate transfer member includes an endless belt, and wherein the current supply member comes into contact with an outer circumferential surface of the endless belt.

10. An image forming apparatus according to claim 9, further comprising:

a secondary transfer member which forms a secondary transfer portion with the endless belt to secondarily transfer the toner image on the endless belt onto a recording material; and a power supply for applying a voltage to the secondary transfer member, wherein the current supply member includes the secondary transfer member, and wherein the endless belt is supplied with a current from the power supply via the secondary transfer member.

11. An image forming apparatus according to claim 9, wherein one of the multiple stretching members comprises an opposing member opposed to the current supply member across the endless belt, and wherein the opposing member is connected to the voltage maintaining element.

12. An image forming apparatus according to claim 1, wherein the voltage maintaining element includes a Zener diode.

13. An image forming apparatus, comprising:

multiple image bearing members which bear toner images, respectively;

an endless intermediate transfer member onto which the toner images are primarily transferred from the multiple image bearing members, the intermediate transfer member being movable and having conductivity;

multiple stretching members for stretching the intermediate transfer belt; and multiple contact members arranged so as to correspond to the multiple image bearing members, respectively, between the multiple stretching members, the multiple contact members being configured to come into contact with an inner circumferential surface of the intermediate transfer member, wherein each of the multiple contact members includes multiple rotary members into which each of the multiple contact members is divided in a direction orthogonal to a moving direction of the intermediate transfer member, wherein each of the multiple contact members is arranged on a downstream side in the moving direction of the intermediate transfer member with respect to a contact portion between the intermediate transfer member and corresponding one of the multiple image bearing members, and wherein the intermediate transfer member is protruded on a side of the multiple image bearing members.

14. An image forming apparatus according to claim 13, further comprising a voltage maintaining element connected to the multiple contact members.

15. An image forming apparatus according to claim 14, further comprising a current supply member which comes into contact with the intermediate transfer member and supplies a current to the intermediate transfer member, wherein the multiple contact members, which are connected to the voltage maintaining element, are maintained at a predetermined potential or higher by the current flowing from the current supply member to the intermediate transfer member.

16. An image forming apparatus according to claim 15, wherein the intermediate transfer member includes an endless belt, and wherein the current supply member comes into contact with an outer circumferential surface of the endless belt.

17. An image forming apparatus according to claim 16, further comprising:

a secondary transfer member which forms a secondary transfer portion with the endless belt to secondarily transfer the toner images on the endless belt onto a recording material; and a power supply for applying a voltage to the secondary transfer member, wherein the current supply member includes the secondary transfer member, and wherein the endless belt is supplied with a current from the power supply via the secondary transfer member.

18. An image forming apparatus according to claim 14, wherein the voltage maintaining element includes a Zener diode.

19. An image forming apparatus, comprising:

an image bearing member which bears a toner image;

an endless intermediate transfer member onto which the toner image is primarily transferred from the image bearing member, the endless intermediate transfer member being movable and having conductivity;

a current supply member which comes into contact with the endless intermediate transfer member and supplies a current to the endless intermediate transfer member;

multiple stretching members for stretching the endless intermediate transfer member;

a contact member arranged between the multiple stretching members and comes into contact with an inner circumferential surface of the endless intermediate transfer member; and a voltage maintaining element connected to the contact member, configured to maintain a voltage of the contact member at a predetermined voltage or more by a current flow from the current supply member through the endless intermediate transfer member;

wherein the contact member includes a metal portion that contacts an inner circumferential surface of the endless intermediate transfer member and insulating members provided on both sides of the metal portion in a direction perpendicular to a moving direction of the endless intermediate transfer member.

20. An image forming apparatus according to claim 19, wherein in a moving direction of the endless intermediate transfer member, the metal portion is provided to correspond to an image region on the image bearing member and the insulating members are provided to correspond to an outside of the image region on the image bearing member.

21. An image forming apparatus according to claim 19, wherein the metal portion includes a metal roller rotatable about a rotation shaft and the insulating members include an insulating rotary member supported around the rotation shaft of the metal roller.

* * * * *